United States Patent [19]

Diefendorf et al.

[11] 4,443,324

[45] Apr. 17, 1984

[54] LOW MELTING MESOPHASE PITCHES

[75] Inventors: Russell J. Diefendorf, Clifton Park; Shih-Heui Chen, Troy, both of N.Y.

[73] Assignee: Exxon Research and Engineering Co., Florham Park, N.J.

[21] Appl. No.: 388,479

[22] Filed: Jun. 14, 1982

[51] Int. Cl.[3] ..... C10C 1/18; C10C 3/08; C10C 3/00

[52] U.S. Cl. ..... 208/22; 208/39; 208/40; 208/44; 208/45; 423/447.2; 423/447.4; 423/447.6; 423/448

[58] Field of Search ..... 208/22, 39, 40, 44, 208/45; 423/447.2, 447.4, 447.6, 448, 449

[56] References Cited

U.S. PATENT DOCUMENTS

| | | | |
|---|---|---|---|
| Re. 27,794 | 10/1973 | Otani et al. | 423/447.6 |
| 2,698,280 | 12/1954 | Hersberger | 208/40 |
| 2,847,359 | 8/1958 | Beuther et al. | 208/40 |
| 2,915,370 | 12/1959 | Mitchell | 423/448 |
| 3,080,245 | 3/1963 | Herman et al. | 208/39 |
| 3,629,379 | 12/1971 | Otani | 423/447.6 |
| 3,718,574 | 2/1973 | Araki et al. | 423/447.7 |
| 4,016,247 | 4/1977 | Otani et al. | 423/447.6 |
| 4,115,527 | 9/1978 | Otani et al. | 423/447.4 |
| 4,209,500 | 6/1980 | Chwastiak | 423/449 |
| 4,273,675 | 6/1981 | Shuki et al. | 423/449 |
| 4,277,325 | 7/1981 | Greenwood | 208/22 |

OTHER PUBLICATIONS

Carbons Produced from known Org. Comp. Ianthracene and Phenanthrene *Carbon,* 1967, V, pp. 13–17, Walker.

Carbon-base Fiber Reinforced Plastics, Chem. Eng. Prog., vol. 58, No. 10, Oct. 1962, pp. 42–80, Schmitt.

*Primary Examiner*—Delbert E. Gantz
*Assistant Examiner*—Helane E. Maull
*Attorney, Agent, or Firm*—Larry Rosen

[57] ABSTRACT

A low melting point, low molecular weight, heptane insoluble, 1,2,4-trichlorobenzene soluble mesophase pitch useful in carbon fiber spinning as such or as a plasticizer in a carbon fiber spinning composition is obtained by heating chrysene, triphenylene or paraterphenyl as well as mixtures thereof and hydrocarbon fractions containing the same, dissolving the resulting heat treated material with 1,2,4-trichlorobenzene, and separating the insolubles, and then contacting the 1,2,4-trichlorobenzene soluble fraction with a sufficient amount of heptane to precipitate the low melting point, low molecular weight mesophase pitch.

7 Claims, No Drawings

LOW MELTING MESOPHASE PITCHES

BACKGROUND OF THE INVENTION

Carbonaceous or graphite articles in fibrous or film form having high anisotropy are made by selecting a substance having a particular chemical structure and properties as a carbon precursor. One known method uses pitch as a raw material which is formed into fibrous shape by melt spinning and thereafter the fibers are subjected to an infusibilization treatment and then to carbonization. Such procedures are described, for example, in U.S. Pat. Nos. 3,629,379; 4,016,247; Re. 27,794; and European Patent Application Publication No. 0026647.

It is generally desirable to use pitches having a high percentage of mesophase as the raw material in carbon fiber spinning. However, these pitches often have high softening temperatures and decompose when spinning at the temperatures encountered during processing which are about 40° C. or more higher than the softening point. The preparation of neomesophase by a solvent separation technique to remove most of the non-mesophase components from the mesophase pitch is described in U.S. Pat. Nos. 4,184,942 and 4,208,267. The neomesophase pitches, however, still require a rather high spinning temperature, and may exhibit non-Newtonian flow and marginal stability.

It is conventional in fiber spinning to add a plasticizer in order to lower the melting temperature of the material being spun and thereby lower the spin temperature. Unfortunately, the small molecules that might be considered as good plasticizers are generally deleterious to the mesophase structure. The plasticizers generally form isotropic liquids and hence depress the mesophase transition temperature in the plasticizer pitch system. While the degree of disruption varies depending on the particular plasticizers, all of such materials are disruptive.

It has now been unexpectedly discovered that, if certain raw materials are treated in a particular way, the resulting product is a low melting, low molecular weight mesophase pitch which can be used as such to obtain carbon fibers by spinning or which can be used as a plasticizer with mesophase or neomesophase pitches which are used to produce carbon fibers.

Accordingly, it is the object of the present invention to provide such low melting, low molecular weight mesophase pitches and a method of preparing them. These and other objects of the invention will become apparent to those skilled in this art from the following detailed description.

SUMMARY OF THE INVENTION

This invention relates to a low melting point, low molecular weight mesophase pitch and the method of its production. More particularly, the invention relates to a low melting, low molecular weight, heptane insoluble, 1,2,4-trichlorobenzene soluble mesophase pitch which can be prepared by heating chrysene, triphenylene or paraterphenyl as well as mixtures thereof and hydrocarbon fractions containing the same, dissolving the heat soaked material with 1,2,4-trichlorobenzene, recovering the insolubles, and contacting the 1,2,4-trichlorobenzene solubles with heptane to precipitate said low molecular weight mesophase pitch therefrom.

Although the chrysene, triphenylene and paraterphenyl are quite different geometrically, each of them or mixtures thereof as well as hydrocarbon cuts containing substantial amounts of them, can be utilized as feed material in the formation of the low melting point mesophase pitches of the present invention. It should be further noted that these precursor materials have molecular weights of 288–230 and similar C/H ratios of 1.29 to 1.5. The resulting mesophase fractions have molecular weights of 900–1000, relatively low viscosity, and a C/H ratio 1.5 to 1.7. This data indicates that the average structure is a tetramer with little ring fusion occurring during processing. There is also a minimal color change, which is consistent with a lack of additional ring fusion. In contrast, thermally produced mesophase pitches may have similar molecular weight but significantly higher C/H ratios, which is indicative of ring fusion, as well as higher melting points. Molecular weights given in this specification have been determined by vapor phase osmometry.

DESCRIPTION OF THE INVENTION

In the first step of the process of this invention, chrysene, triphenylene, para-terphenyl or a mixture thereof is heavied, for example, by heat soaking at an elevated temperature for an extended period of time in a non-oxidizing atmosphere in the conventional manner. See, for example, U.S. Pat. No. 3,718,574. The heavying of pitches by heat treatment is mainly based on polycondensation. When a catalyst is not used, the elevated temperature is generally in the range of about 300°–600° C., usually at least 400° C., for a time which can vary from about 0.5–30 hours or more in order to obtain a heat soaked product which contains a substantial percentage of mesophase. The heat soaking is continued under the selected time and temperature parameters until the resulting heat soaked material preferably has a carbon content of at least 95% by weight, a mean molecular weight of more than 400, is capable of assuming a uniform molten state of a temperature range of from 320°–480° C., and has a melt viscosity of greater than 0.4 poise but not exceeding 700 poises.

The time and temperature conditions used to form the desired pitch can be reduced substantially by employing a Lewis acid catalyst such as $AlCl_3$, $FeCl_3$ and the like, which is capable of forming $\pi$-type complex compounds with the raw material. When such a catalyst is used, the catalyst residue should be destroyed by dissolving the heat soaked material in a suitable solvent and adding appropriate amounts of acid and/or base.

In the next step of the process of this invention the heat soaked raw material is contacted with a sufficient amount of 1,2,4-trichlorobenzene to dissolve all portions soluble therein. In general, at least about 50 ml. of 1,2,4-trichlorobenzene is used per gram of heat soaked raw material. This step can be accomplished under ambient temperature and pressure conditions. Thereafter, the soluble fraction is collected by any suitable means such as by filtration.

In the next step of the process of this invention, the 1,2,4-trichlorobenzene soluble fraction is contacted with a sufficient amount of heptane so that the heptane soluble components are dissolved therein. In general, the volumes of heptane solvent will be at least about 5 times the volume of the solution being treated, preferably an excess of heptane is used to ensure complete dissolution of the heptane soluble fraction. This step can also be performed under ambient temperature and pressure conditions.

After recovery of the heptane insoluble, 1,2,4-trichlorobenzene soluble fraction, it can be used as such as a plasticizer for conventional mesophase and neomesophase pitches. Alternatively, the heptane-insoluble fraction can be evaporated to dryness and used in conventional carbon fiber spinning. For economic reasons, it is preferred to use the low melting point, low molecular weight mesophase pitch so produced as a plasticizer.

The heptane insoluble, 1,2,4-trichlorobenzene soluble pitch realized by the process of the present invention is a low melting, low molecular weight, 100% mesophase pitch. In general, the molecular weight is less than about 1000, preferably about 900, and the melting point is less than about 250° C., preferably about 230° C.

The new low melting, low molecular weight mesophase pitch is, when used as a plasticizer, employed in an effective plasticizing amount. The particular amount employed will of course depend on the particular mesophase or neomesophase pitch to which it is added, and the exact amount can readily be determined by those skilled in this art.

Fibers or films are formed from the mesophase pitch or pitches containing the low melting point, low molecular weight mesophase pitches of this invention as a plasticizer in the conventional manner. The fibrous shape is achieved by melt spinning and thereafter subjecting the resulting fibers to an infusibilization treatment and then to carbonization.

The infusibilization treatment after shaping is usually carried out in an oxidizing atmosphere such as ozone, oxygen, oxides of nitrogen, halogens and sulfur trioxides or an atmosphere containing one or more of these gases or in sulfur vapor. Contacting the pitch fibers after the oxidation treatment with ammonia gas usually accelerates the infusibilization and also improves the carbonization yield and the mechanical strength of the carbon fibers. The shaped body which has been subject to infusibilization is then carbonized or graphitized in a non-oxidizing atmosphere.

The invention will be more fully understood by reference to the following illustrative examples. Throughout this specification and claims all parts and percentages are by weight and all temperatures in degrees Celsius.

EXAMPLE 1

An amount of $AlCl_3$ equal to 6% based on the weight of chrysene was mixed with the chrysene and the resulting mixture was heat soaked at 270° C. for 20 hours. The heat treated mixture was dissolved in 1,2,4-trichlorobenzene (TCB) to a concentration of 10 grams per liter and the insoluble portion removed by filtration. The soluble portions were vacuum distilled to 60 milliliters and then combined with 60 ml of KOH solution containing the base at a concentration of 10 grams per liter. The KOH solution was removed from the trichlorobenzene solution by means of a separatory funnel. The procedure was then repeated using 60 ml of a 10% hydrochloric acid solution.

Thereafter, the trichlorobenzene solution was mixed with 600 ml of heptane and the precipitated solids collected by filtration.

EXAMPLE 2

Example 1 was repeated except that triphenylene was used in place of the chrysene and the heat soaking was effected at 260° C. for 10 hours. Mesophase formation was observed at 250° C.

EXAMPLE 3

Example 1 was repeated except that para-terphenyl was employed instead of the chrysene and the heat soaking was conducted at 300° C. for 4 hours. The heat treated mixture was dissolved in toluene at a concentration of 20 gm/l. The toluene insoluble portion was recovered by filtration and then redissolved into TCB. The rest of the procedure was the same as followed in Example 1. Mesophase formation was observed at about 250° C.

Various changes and modifications can be made in the process and products of this invention without departing from the spirit and scope thereof. Thus, for example, thermal or catalytic procedures can be employed to effect the heat treatment step, which is believed to involve a mild polymerization. On the other hand, the solvents employed at the various stages may be varied, since their function is to remove unreacted feed material, intermediate by-products such as dimers and trimers, as well as isotropic and non-mesophase formers from the desirable fractions. More particularly, solvents which will perform substantially the same function as the 1,2,4-trichlorobenzene and the heptane can also be utilized in practicing the present invention. The choice of particular solvents employed will depend to some extent upon the C/H ratios and melting points of reaction product mixture following heat treatment as well as upon the exact type of final product desired. It is also possible to employ an additional preliminary as well as intermediate solvent extraction step to remove high molecular weight components, if desired.

What is claimed is:

1. A low melting, low molecular weight, heptane insoluble, 1,2,4-trichlorobenzene soluble mesophase pitch having a melting point of less than about 250° C. and a molecular weight of less than about 1000 prepared by the method which comprises heating a feed material selected from the group consisting of chrysene, triphenylene, and para-terphenyl, dissolving the heated material with 1,2,4-trichlorobenzene and recovering the soluble portion therefrom contacting the resulting 1,2,4-trichlorobenzene solution with heptane to precipitate said heptane insoluble, 1,2,4-trichlorobenzene soluble mesophase pitch.

2. The pitch of claim 1 also characterized by a C/H ratio of about 1.5 to 1.7.

3. A method of making a low melting, low molecular weight, heptane insoluble, 1,2,4-trichlorobenzene soluble mesophase pitch which comprises heating a feed material selected from the group consisting of chrysene, triphenylene, and para-terphenyl, dissolving the heated material with 1,2,4-trichlorobenzene and recovering the soluble portion therefrom contacting the resulting 1,2,4-trichlorobenzene solution with heptane to precipitate said heptane insoluble, 1,2,4-trichlorobenzene soluble mesophase pitch.

4. The method of claim 3 wherein said feed material is chrysene.

5. The method of claim 3 wherein said feed material is triphenylene.

6. The method of claim 3 wherein said feed material is paraterphenyl.

7. The method of claim 3 wherein said heating is effected by heat soaking at a temperature above about 300° C.

* * * * *